US009238531B2

(12) United States Patent
Himmelsbach et al.

(10) Patent No.: US 9,238,531 B2
(45) Date of Patent: Jan. 19, 2016

(54) RECLOSABLE POURING ELEMENT WITH BARRIER FILM AND A SUPPORT WALL

(75) Inventors: Sven Himmelsbach, Stein am Rhein (CH); Markus Wassum, Buch (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 8 days.

(21) Appl. No.: 13/878,903

(22) PCT Filed: Aug. 25, 2011

(86) PCT No.: PCT/EP2011/064596

§ 371 (c)(1),
(2), (4) Date: Jun. 13, 2013

(87) PCT Pub. No.: WO2012/048935

PCT Pub. Date: Apr. 19, 2012

(65) Prior Publication Data

US 2013/0256336 A1 Oct. 3, 2013

(30) Foreign Application Priority Data

Oct. 15, 2010 (DE) ..... 10 2010 048 415

(51) Int. Cl.

| | |
|---|---|
| ***B67D 1/00*** | (2006.01) |
| ***B65D 47/14*** | (2006.01) |
| ***B65D 5/74*** | (2006.01) |

(52) U.S. Cl.

CPC ..... *B65D 47/14* (2013.01); *B65D 5/748* (2013.01); *B65D 2101/0023* (2013.01); *B65D 2251/0015* (2013.01); *B65D 2251/0062* (2013.01); *B65D 2251/0093* (2013.01)

(58) Field of Classification Search

CPC ..... B67D 1/00; B65D 17/42; B65D 47/10
USPC ..... 220/267, 276–278; 222/80–91, 541.2, 222/541.6

See application file for complete search history.

(56) References Cited

U.S. PATENT DOCUMENTS

| | | | | |
|---|---|---|---|---|
| 4,948,015 | A | 8/1990 | Kawajiri et al. | |
| 6,402,019 | B1 | 6/2002 | Casale | |
| 7,036,683 | B2 * | 5/2006 | Dubach | 222/83 |
| 2003/0127467 | A1 * | 7/2003 | Adams et al. | 222/153.14 |
| 2005/0252931 | A1 * | 11/2005 | Moulton | 222/83 |
| 2007/0095834 | A1 * | 5/2007 | Von Spreckelsen et al. | 220/258.2 |
| 2008/0179331 | A1 * | 7/2008 | Sharp | 220/521 |

(Continued)

FOREIGN PATENT DOCUMENTS

| | | | |
|---|---|---|---|
| DE | 102006016113 | B3 | 8/2007 |
| JP | 2004210298 | A | 7/2004 |

(Continued)

*Primary Examiner* — Paul R Durand
*Assistant Examiner* — Andrew P Bainbridge
(74) *Attorney, Agent, or Firm* — The Webb Law Firm

(57) ABSTRACT

A reclosable pouring element for liquids contained in packagings, in particular liquid food, including a base body, which has a pouring opening, an external thread and a flange for connection to the packaging, a cutting ring, which has a cutting edge and a projection, and a screw lid, which has an internal thread and an actuator, the pouring opening being closed by a barrier film. To achieve improved protection of the barrier film against damage while still having a reliable opening function of the pouring element, it is proposed that the base body has a support wall, on which the barrier film rests.

17 Claims, 7 Drawing Sheets

(56) References Cited

U.S. PATENT DOCUMENTS

| | | | | |
|---|---|---|---|---|
| 2008/0210707 | A1* | 9/2008 | Kitai | 222/1 |
| 2009/0020494 | A1 | 1/2009 | Seelhofer | |
| 2011/0147414 | A1* | 6/2011 | Chen | 222/83 |

FOREIGN PATENT DOCUMENTS

| | | | |
|---|---|---|---|
| JP | 2004210299 | A | 7/2004 |
| WO | 2007085106 | A1 | 8/2007 |

* cited by examiner

RECLOSABLE POURING ELEMENT WITH BARRIER FILM AND A SUPPORT WALL

BACKGROUND OF THE INVENTION

1. Field of the Invention

The invention relates to a reclosable pouring element for liquids contained in packagings, in particular liquid food, with a base body, which has a pouring opening, an external thread and a flange for connection to the packaging, a cutting ring, which has at least one cutting edge and a projection, and a screw lid, which has an internal thread and at least one actuator, the pouring opening being closed by a barrier film.

2. Description of Prior Art

Reclosable pouring elements for food contained in packagings are known from practice in diverse configurations. A typical structure provides three elements: a base body, which is applied to the packaging; a cutting ring, which cuts open the packaging the first time it is opened; and a screw lid, which is used to open and close the packaging.

The base body regularly has a pouring opening. This pouring opening is frequently sealed from the inside of the packaging with a gas-tight and water-tight film, in order to completely seal the packaging and protect the content of the packaging from environmental influences.

The at least one actuator may, in this case, in turn be provided with a thread.

A reclosable pouring element, in which the pouring opening is closed with a barrier film is known from U.S. Pat. No. 6,702,161 B1.

A generic pouring element is also known from U.S. Pat. No. 4,948,015 and is described therein FIGS. 9 to 13 as the third embodiment and is known from WO-A1-2007/085106. The pouring element consists of a base body with a peripheral flange, which is connected to the inside of the packaging, a screw lid and a cutting element. The screw lid has an internal thread, which cooperates with an external thread provided on the base body. In addition, the screw lid has an external thread located on the inside, which cooperates with an internal thread provided on the cutting element. The base body has a cylindrical pouring opening, which is sealed by a barrier film in its lower region. When the screw lid is opened for the first time, the barrier film is to be cut open by the cutting element.

The pouring element shown in U.S. Pat. No. 4,948,015 has the drawback that the sensitive barrier film is arranged substantially unprotected and can therefore be easily damaged. On the one hand, the content of the packaging can be pressed from the inside against the barrier film during transportation, so the barrier film could be pushed in or detached. On the other hand, the barrier film could be pressed in the direction of the pouring opening and thus be inadvertently damaged by the cutting element arranged closely above the barrier film.

US-A1-2007/095834 also discloses a reclosable pouring element, in which the screw lid and the part to be removed are not joined together mechanically. In its interior, this pouring element also has a wall as a removable portion. However, this wall which is already known per se is not used to support the barrier film located below, but to attach the opening element configured as a ring pull.

SUMMARY OF THE INVENTION

The invention is therefore based on the object of configuring and developing the pouring element mentioned at the outset and described more closely above in such a way that an improved protection of the barrier film from damage is achieved with a still reliable opening function of the pouring element.

This object is achieved in a pouring element in that the base body has a support wall on which the barrier film rests. The support wall preferably has a higher degree of rigidity than the barrier film and is therefore used as a reinforcement of the barrier film. The support wall ay absorb the forces acing on the barrier film and deflect them into the base body, owing to the use of a support wall, the sensitive barrier film is no longer the weakest point of the packaging and is better protected against mechanical damage. The threads can be formed as threads with a constant pitch or as threads with a variable pitch. The threads may be single-start or multi-start. A thread, in the framework of the invention, is not only taken to mean a continuous, spiral turn of a thread. The designation "thread" also means alternative guide elements, which cooperate in such a way that a rotational movement is converted into a translational movement.

According to a further teaching of the invention, for particularly favourable production, it may be provided that the base body and the support wall are formed in one piece. A one-piece configuration of the base body and support wall has the advantage that the three-part structure of the pouring element is retained. By avoiding further components, assembly can remain substantially unchanged. The one-piece configuration also allows the use of favourable production methods, such as, for example, injection moulding.

The barrier film can be attached particularly easily by the support wall and the flange being arranged in one plane according to a further configuration of the invention. By arranging the support wall and the flange in the same plan, a level face is provided, on which the barrier film can be placed. By avoiding sharp edges and pointed corners, damage to the barrier film is substantially ruled out.

According to a further teaching of the invention, it is provided that the support wall be connected to the base body by at least one separating point. The separating point, owing to the selection of the material and/or the shaping, has less stability than the remaining regions of the pouring element and is therefore formed as a desired rupture point. The separating point therefore allows simple opening of the pouring opening by means of the cutting edge of the cutting ring, despite the reinforcement function of the support wall.

It is proposed in a further configuration that the separating point be configured as a web, material bridge or peripheral thin point. The connection of the support wall and base body by means of webs or material bridges has the advantage that an economical use of material is possible and that the separating points can be particularly easily broken open or cut open by the cutting edge. A peripheral thin point, on the other hand, makes it possible for the support wall to even be able to absorb relatively large forces and therefore to offer a high degree of dimensional stability to support the barrier film.

According to a further configuration of the invention, it is provided that the barrier film rests on the support wall and on the flange. An optimal seal of the packaging into the edge region of the flange can be achieved by the barrier film extending beyond the region of the support wall and also covering parts of the flange. The barrier film preferably extends to the edge of the flange, so that an overlap is produced with the region in which the flange is fastened to the packaging.

A particularly good seal is achieved according to a further configuration in that the barrier film is sealed, in particular welded, to the base body in the region of the support wall and in the region of the flange. By means of a seal, in particular a weld, a uniform and flat connection is achieved between the barrier film and support wall or flange. This results in a high degree of sealing of the seam point. The sealing is preferably realised as a material-uniting connection. Adhesive methods or welding methods, in particular ultrasonic welding, can preferably be used for sealing.

Safe opening of the pouring channel is ensured in a further configuration of the invention in that the barrier film is not sealed to the base body in the region of the separating point. Series of tests have shown that the cutting edge can break open or cut open the separating point more uniformly and with less force if no sealing with the barrier film takes place in the region of the separating point. By dispensing locally with a seal, and therefore with the influence of thermal and/or chemical energy, the material properties remain unchanged in this region.

According to a further teaching of the invention, it is provided that the barrier film has at least one barrier layer, in particular a barrier layer made of EVOH, $AlO_x$, or $SiO_x$. Depending on the requirements, layers of various materials such as ethylene vinyl alcohol (EVOH), polyethylene terephthalate (PET) can be used as the carrier layer, (and) aluminium oxide ($AlO_x$) or silicon oxide ($SiO_x$). Films can be processed particularly well, can be selected in various thicknesses and are therefore particularly suitable as a barrier film. The barrier film may also be produced by vapour deposition, for example aluminium vapour deposition.

Moreover, a further configuration of the invention provides that the barrier film is formed as a multi-layer or multi-coating film, in particular as a laminate. The properties of single-layer or single-coating films of different materials can be combined into a laminate by means of multi-layer films. Depending on the material and thickness of the individual layers, laminates with the most varied properties can be produced.

In a further configuration of the invention, it is proposed that the barrier film be gas-tight and/or liquid-tight. Many foods are sensitive and have to be protected as well as possible from environmental influences. The entry of gases, in particular oxygen, would accelerate the increase in germs and therefore reduce the durability of the food contained. This can be prevented by a gas-tight barrier film. At the same time, the packaging can prevent the entry and discharge of liquids by a liquid-tight barrier film. The barrier film can preferably also prevent the entry of light.

A tamper-proof seal is achieved according to a further configuration of the invention in that the screw lid is connected to the base body, in the assembled position, by means of a material bridge formed as a desired rupture point. Consumers can thus see at a glance whether a packaging with a closed screw lid has already been opened beforehand and that the content is possibly no longer fresh.

A further configuration of the invention provides that the base body has an internal thread. The internal thread of the base body cooperates with the cutting ring so that no second thread needs to be provided on the screw lid.

Finally, it is provided in a further configuration of the invention that the cutting ring has an external thread. The external thread of the cutting ring cooperates with the internal thread of the base body. Alternatively or cumulatively, if also less preferred, the cutting ring can cooperate with the screw lid by means of a further thread. Since the thread of the cutting ring rests on the outside thereof, the inside of the cutting ring can be smooth, so the content of the packaging can flow more easily through the cutting ring.

DETAILED DESCRIPTION OF THE INVENTION

Figure 1:
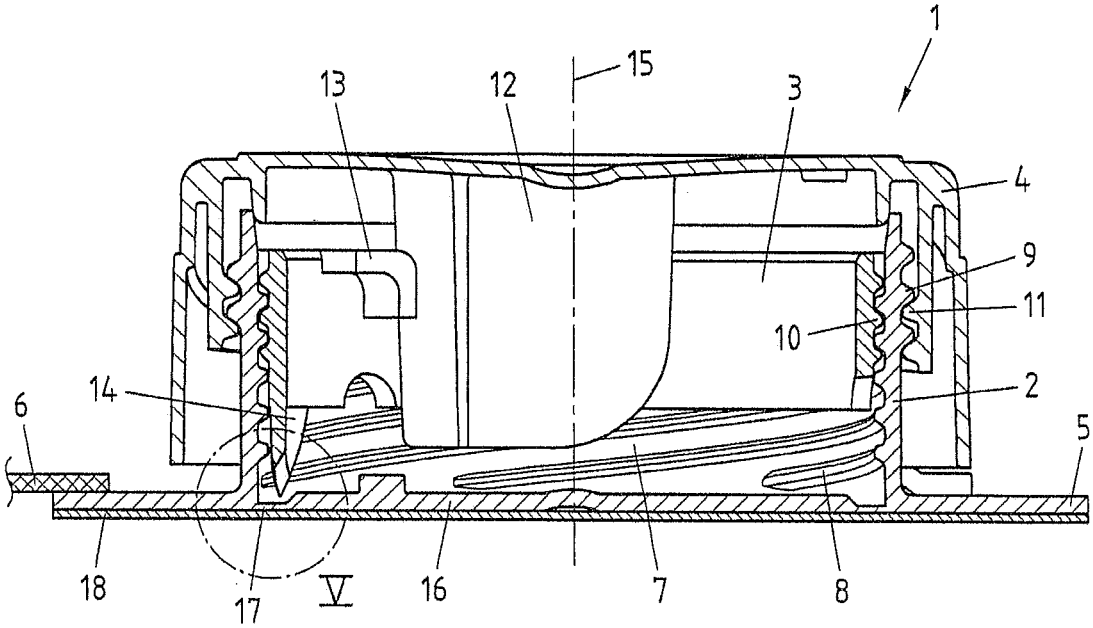
FIG. 1 shows a first configuration of a three-part pouring element in the assembled state in a sectional view.

FIG. 1 shows a first configuration of a three-part pouring element 1 in the assembled state in a sectional view. The pouring element 1 is reclosable and substantially consists of three parts, namely a base body 2, a cutting ring 3 and a screw lid 4. The three parts of the pouring element 1 are generally produced from plastics material. The base body 2 has a peripheral flange 5, which can be connected to the packaging 6. The base body 2 forms a cylindrical pouring opening 7 in its central region. On the walls of the pouring opening 7, the base body 2 has both an internal thread 8 and an external thread 9. The internal thread 8 of the base body 2 cooperates with an external thread 10 of the cutting ring 3, while the external thread 9 of the base body 2 cooperates with an internal thread 11 of the screw lid 4.

The screw lid 4, in its interior, has at least one actuator 12, which transmits the rotational force produced during the opening of the screw lid 4 onto a projection 13 of the cutting ring 3. The cutting ring 3 has at least one cutting edge 14. The external thread 9 of the base body 2 and the internal thread 11 of the screw lid 4 have a pitch, which opposes the pitch of the internal thread 8 of the base body 2 and of the external thread 10 of the cutting ring 3. This means that the screw lid 4, upon a rotation in the anti-clockwise direction about a vertical axis 15, lifts from the packaging, while the cutting ring 3 is also rotated in the anti-clockwise direction, but moves axially in the opposite direction, in other words in the direction of the packaging interior.

In the lower region of the pouring opening 7, the base body 2 has a support wall 16. The support wall 16 is connected by at least one separating point 17 to the base body 2. The separating point 17 may be formed as a web or material bridge. Likewise, the separating point 17 may be formed as a peripheral thin point or weakening. The lower side of the base body 2, in other words the lower side of the flange 5 and the lower side of the support wall 16 are covered with a barrier film 18. When the screw lid 4 is opened, the cutting edge 14 opens the separating point 17 and the barrier film 18 in the region of the separating point 17 and turns over the support wall 16 and the barrier film 18, so the pouring opening 7 is exposed. The content of the packaging can thus move to the outside through the pouring opening 7 and be removed from the packaging. The cutting edge(s) 14 preferably has/have only one circle of action of less than 360° during the opening process so the support wall 16 is not completely detached from the base body 2 and can fall into the interior of the packaging, but is merely folded into the interior of the packaging by the cutting ring 3. Nevertheless, the cutting ring 3 is located in such a deep position when the screw lid is opened that the support wall 16 folded into the interior of the packaging is prevented by the cutting ring 3 from being folded back during the pouring process. This ensures that the pouring opening 7, when the screw lid 4 is opened, is not blocked by the support wall 16, so that it is possible to allow the packaging content to flow conveniently from the packaging.

Figure 2:
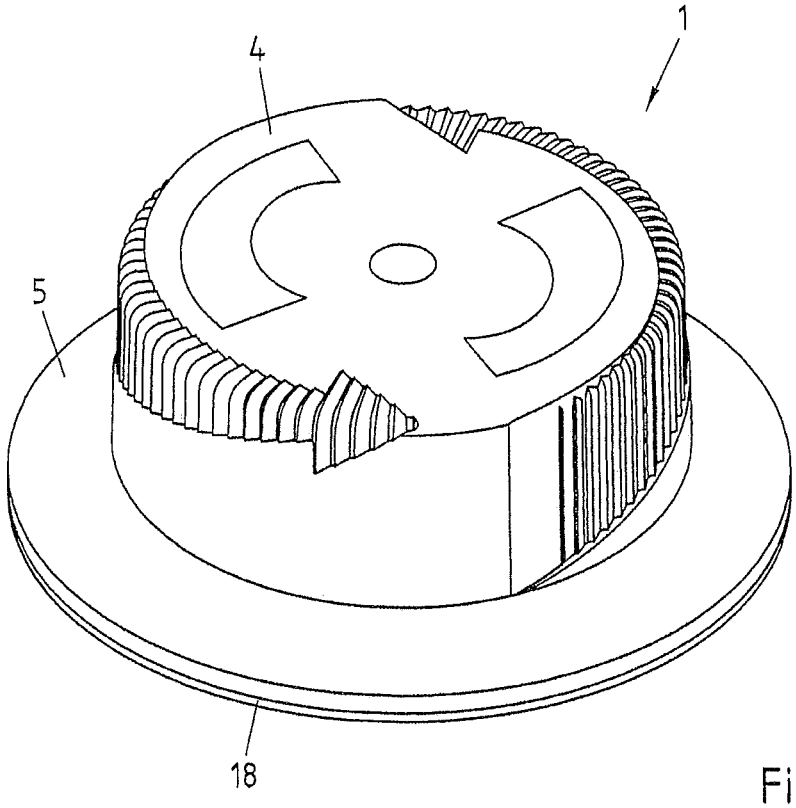
FIG. 2 shows the pouring element shown in FIG. 1 in a perspective view.

FIG. 2 shows the pouring element 1 from FIG. 1 in a perspective view. The screw lid 4 and the projecting flange 5 of the base body 2 can be seen. The cutting ring 3 is located below the screw lid 4 and can therefore not be seen in FIG. 2. The barrier film 18 is shown below the flange 5. In the configuration shown in FIG. 2, the flange 5 is round.

Figure 3:
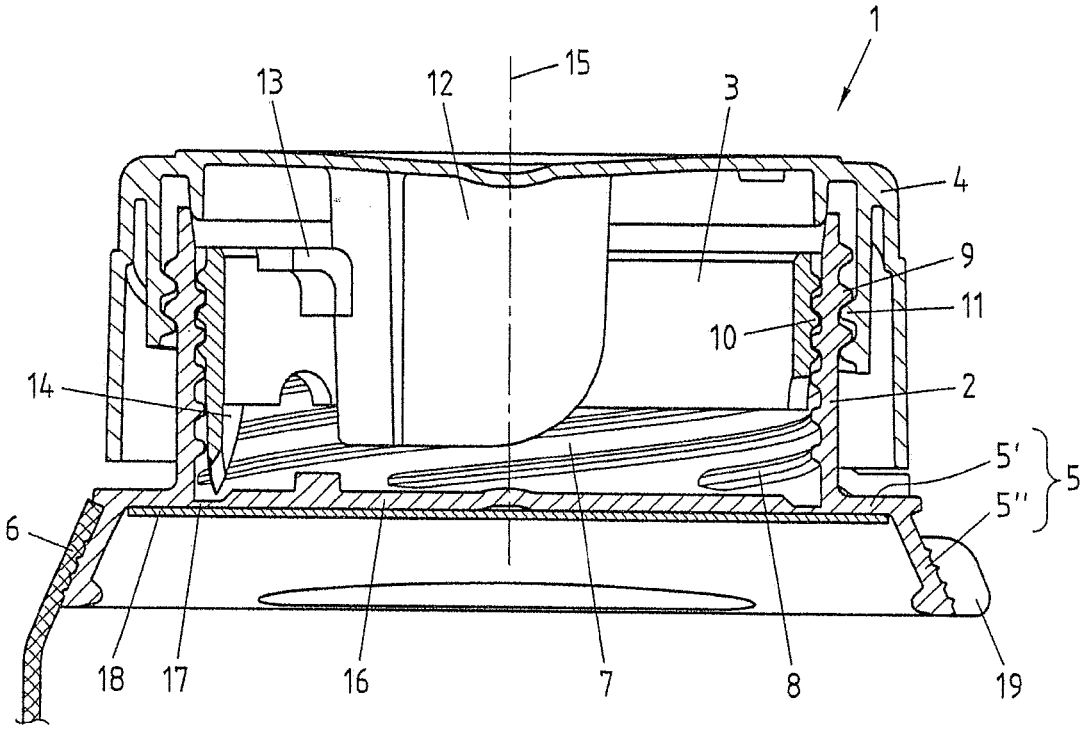
FIG. 3 shows a second configuration of a three-part pouring element in the assembled state in a sectional view.

A second configuration of a three-part pouring element 1 in the assembled state is shown in a sectional view in FIG. 3. The cutting ring 3 and the screw lid 4 are unchanged compared to the first configuration of the pouring element. The important difference from the pouring element shown in FIG. 1 is the different design of the flange 5. The flange 5 is formed, in the configuration shown in FIG. 3, from a flange 5' running radially with regard to the vertical axis 15 and from an angled and rather axially running flange 5". The flange 5' extending in the radial direction is arranged in a plane with the support wall 16. Both the support wall 16 and the flange 5' are covered with the barrier film 18 on their lower side. The angled flange 5" can be connected at its outside to the packaging 6. In the configuration shown, the flange 5 is square and has attachments 19 at its corners, said attachments being to improve the connection between the packaging 6 and flange 5".

Figure 4:
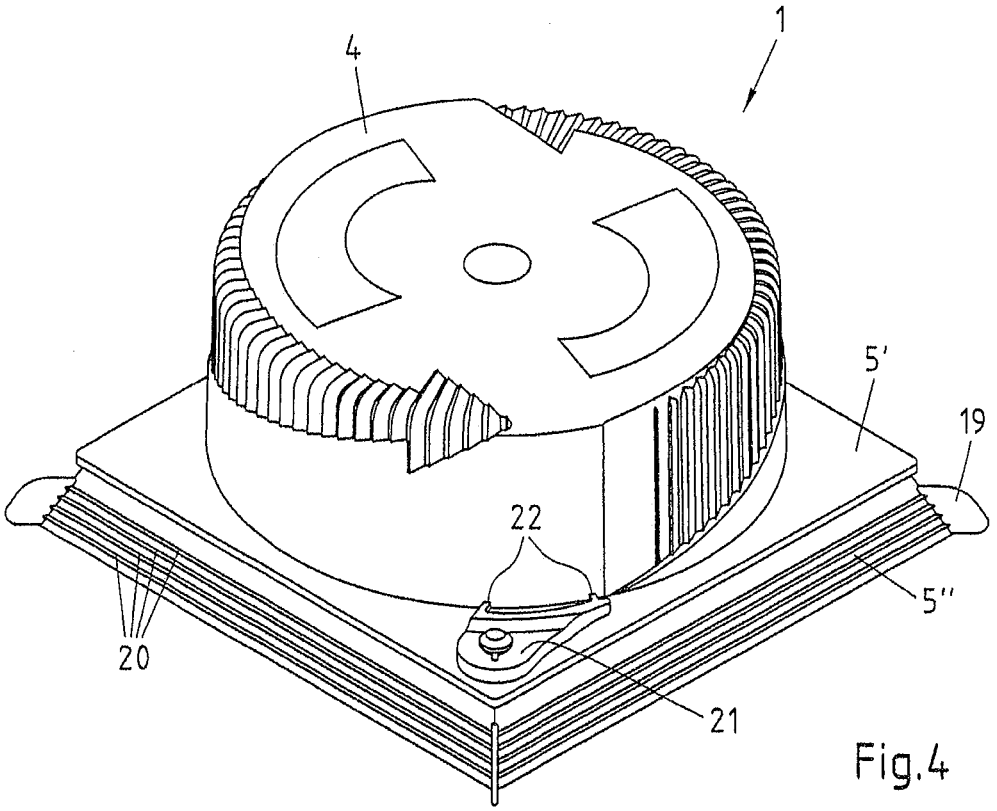
FIG. 4 shows the pouring element shown in FIG. 3 in a perspective view.

FIG. 4 shows the pouring element 1 from FIG. 3 in a perspective view. The square form of the flange 5 can easily be seen. The angled flanges 5" have ribs 20, which, on the one hand, are to mechanically reinforce the flanges 5" and, on the other hand, like the attachments 19, are to make possible a better attachment of the packaging 6 to the flange 5. An tamper-proof seal 21 with material bridges 22 formed as desired rupture points connects the base body 2 to the screw lid 4. During the first opening, the material bridges 22 are destroyed, so a consumer can easily see whether the packaging has already been opened beforehand.

Figure 5:
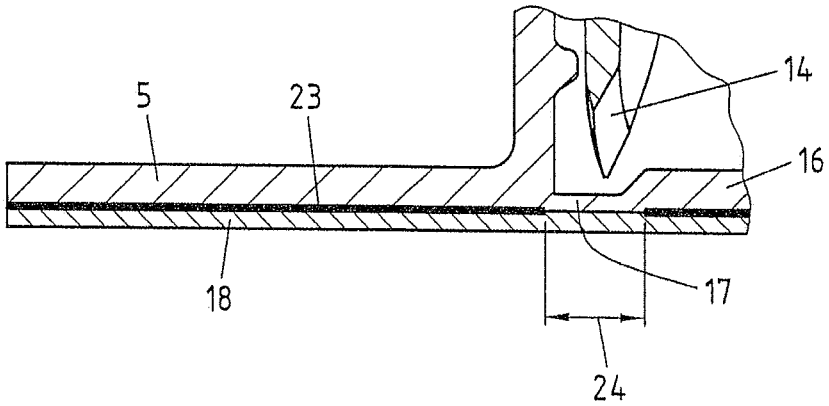
FIG. 5 shows an enlarged view of the region V of the pouring element shown in FIG. 1.

The region V around the left separating point 17 of the pouring element 1 shown in FIG. 1 is shown greatly enlarged in FIG. 5. Apart from the differently formed flange 5, the view can also be applied, however, to the pouring element 1 shown in FIG. 3. The flange 5, the support wall 16 and the separating point 17 lie in one plane and together form, on the lower side, a level face for applying the barrier film 18. The barrier film 18 is sealed to the flange 5 and the support wall 16, which is shown by a seal 23. The seal 23 is taken to mean a material-uniting connection, in particular a weld or adhesion. In the region of the separating point 17, the barrier film 18 is not sealed to the base body 2. The seal 23 in the region of the separating point 17 therefore has a gap. This region is called an unsealed region 24. The cutting edge 14 can substantially more easily cut through the separating point 17 if the barrier film 18 is not sealed to the base body 2 in the region of the separating point 17. In addition, the cutting ring 3 can more easily fold the support wall 16 into the interior of the packing 6 if no seal 23 has taken place in the region remaining as a hinge between the base body 2 and support wall 16. Likewise, it can be seen in FIG. 5 that the barrier film 18 through to the outer edge of the flange 5 is sealed to the flange 5. This is to avoid the edge of the barrier film 18 loosely projecting from the base body 2.

Figure 6:
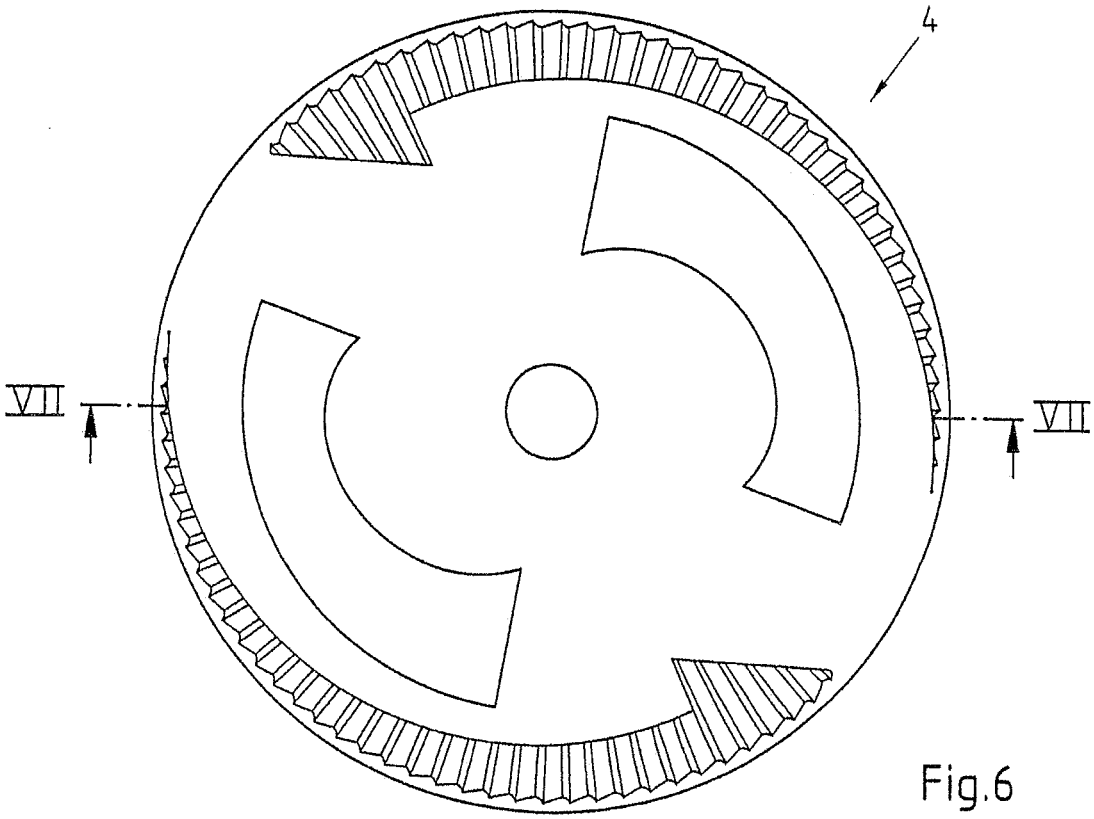
FIG. 6 shows a screw lid in a plan view.
Figure 7:
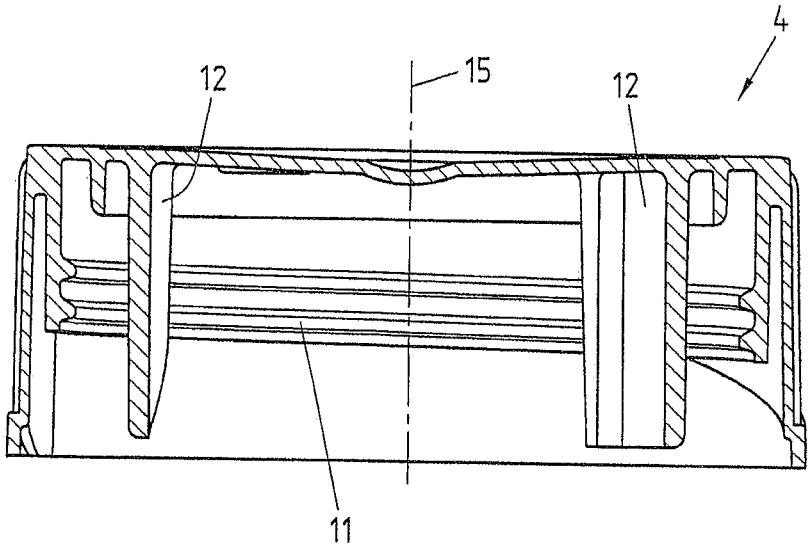
FIG. 7 shows the screw lid shown in FIG. 6 in a sectional view along the line VII-VII from FIG. 6.

The screw lid 4 is shown in FIGS. 6 to 9. FIG. 6 shows the screw lid 4 in a plan view. FIG. 7 shows the screw lid 4 in a sectional view along the line VII-VII from FIG. 6. The screw lid 4 has, in its interior, two actuators 12, which transmit a rotational movement of the screw lid 4 to the cutting ring 3, not shown in FIG. 6. The internal thread 11, which cooperates with the external thread 9, not shown, of the base body 2, is also arranged in the interior of the screw lid 4.

Figure 8:
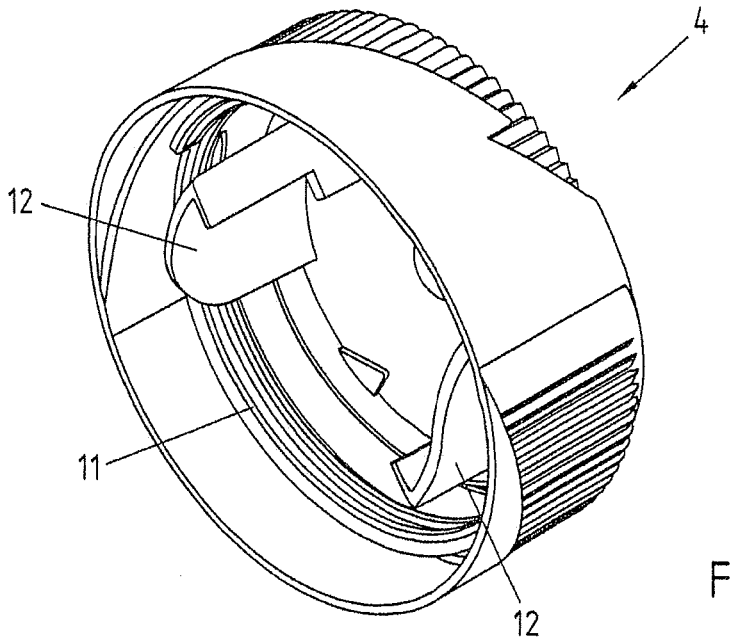
FIG. 8 shows a perspective view of the screw lid from FIG. 6.
Figure 9:
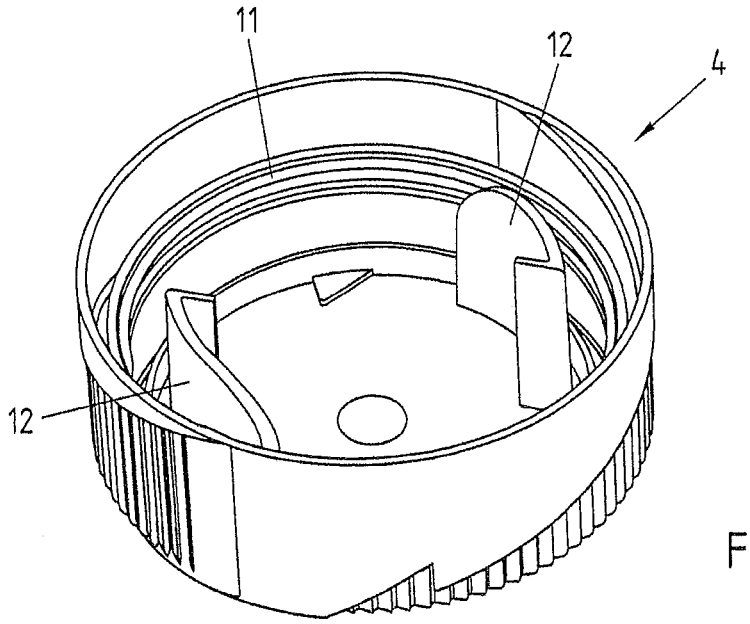
FIG. 9 shows a further perspective view of the screw lid from FIG. 6.

The screw lid 4 is shown in a perspective view in FIGS. 8 and 9. The screw lid 4 shown in FIGS. 8 and 9 also has two actuators 12 and an internal thread 11. The actuators 12, on the side associated with the projection 13 of the cutting ring 3, have an enlarged contact face. This contact face is formed in such a way that the actuator 12 can reliably transmit the rotational force via the projection 13 to the cutting ring 3 and that the projection 13, during the opening process, can slide in the axial direction on the contact face.

Figure 10:
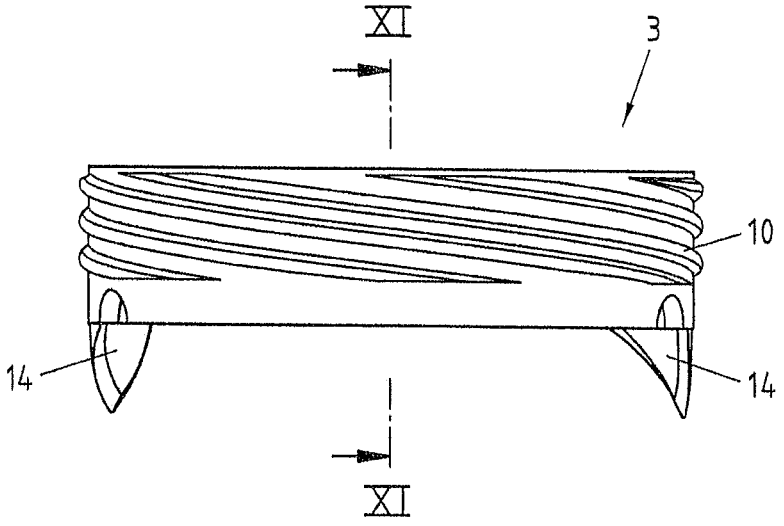
FIG. 10 shows a cutting ring in a side view.
Figure 11:
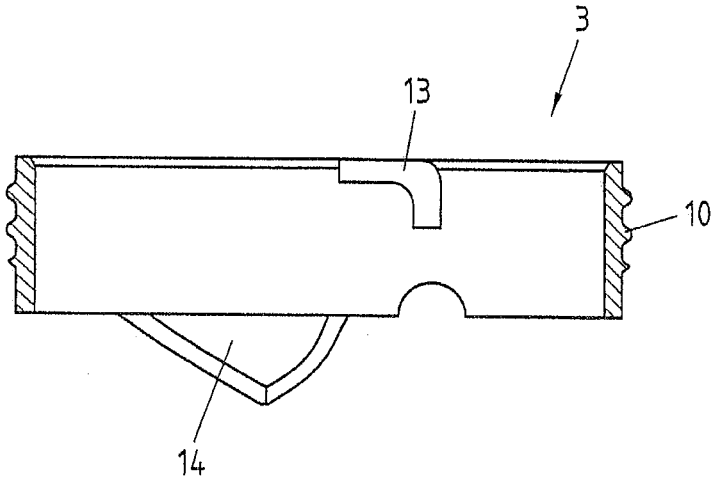
FIG. 11 shows the cutting ring shown in FIG. 10 in a sectional view along the line XI-XI from FIG. 10.
Figure 12:
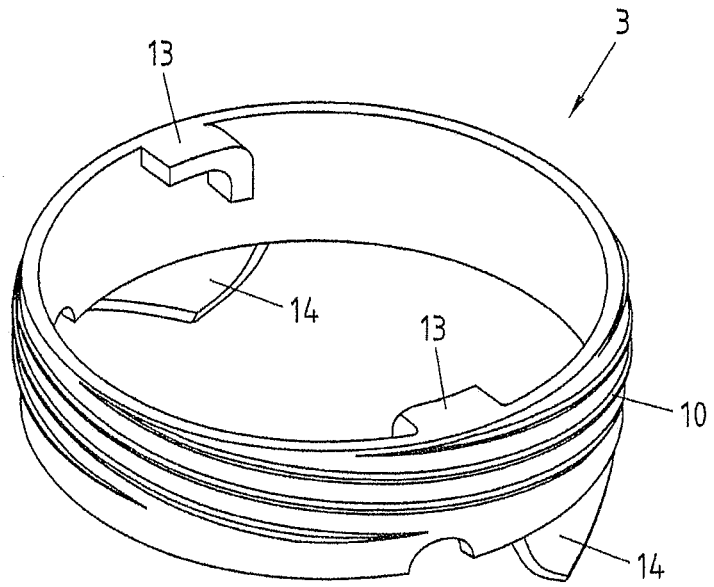
FIG. 12 shows a perspective view of the cutting ring from FIG. 10.
Figure 13:
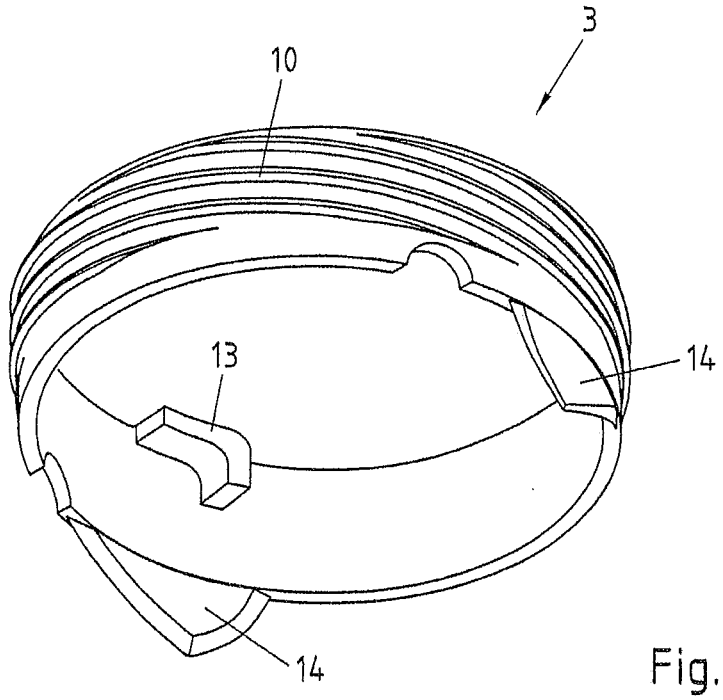
FIG. 13 shows a further perspective view of the cutting ring from FIG. 10.

The cutting ring 3 is shown in FIGS. 10 to 13. In FIG. 10, the cutting ring 3 is shown from the side. The cutting ring has two cutting edges 14 and an external thread 10. FIG. 11 shows the cutting ring 3 shown in FIG. 10 in a sectional view along the line XI-XI from FIG. 10. Apart from the cutting edge 14 and the external thread 10, the projection 13, which cooperates with the actuator 12, not shown, of the screw lid 4, can also be seen in this view. FIG. 12 shows the cutting ring 3 from FIG. 10 in a perspective view. The cutting ring 3, apart from the external thread 10, has two opposing cutting edges 14 and two also opposing projections 13. FIG. 13 shows the cutting ring 3 from FIG. 10 in a further perspective view. Two cutting edges 14 and one of the two projections 13 are also shown here, apart from the external thread 10.

The invention claimed is:

1. A reclosable pouring element for liquids contained in packagings comprising:

a base body, which has a pouring opening, an external thread and a flange for connection to the packaging, a cutting ring, which has at least one cutting edge and a projection, and a screw lid, which has an internal thread and at least one actuator, wherein the pouring opening is closed by a barrier film, and the base body has in the lower region of the pouring opening a support wall, on which the barrier film rests and the lower side of the flange and the lower side of the support wall are covered by the barrier film, and wherein the support wall is connected to the base body by at least one separating point and the bather film is not sealed to the base body in the region of the separating point.

2. The reclosable pouring element according to claim 1, wherein the base body and the support wall are formed in one piece.

3. The reclosable pouring element according to claim 1, wherein the support wall and the flange are arranged in one plane.

4. The reclosable pouring element according to claim 1, wherein the separating point is formed as a web, material bridge or peripheral thin point.

5. The reclosable pouring element according to claim wherein the barrier film rests on the support wall and on the flange.

6. The reclosable pouring element according to claim 1, wherein the barrier film is sealed to the base body in a region of the support wall and in a region of the flange.

7. The reclosable pouring element according to claim 1, wherein the barrier film has at least one barrier layer.

8. The reclosable pouring element according to claim 1, wherein the barrier film is formed as a multi-layer or multi-coating film.

9. The reclosable pouring element according to claim 1, wherein the barrier film is gas-tight, liquid-tight, or both.

10. The reclosable pouring element according to claim 1, wherein the screw lid, in the assembled position, is connected to the base body by means of a material bridge formed as a desired rupture point.

11. The reclosable pouring element according to claim 1, wherein the base body has an internal thread.

12. The reclosable pouring element according to claim 1, wherein the cutting ring has an external thread.

13. The reclosable pouring element according to claim 6, wherein the barrier film is welded to the base body in a region of the support wall and in a region of the flange.

14. The reclosable pouring element according to claim 7, wherein the barrier layer is made of EVOH, $AlO_x$, or $SiO_x$.

15. The reclosable pouring element according to claim 8, wherein the barrier film is a laminate.

16. The reclosable pouring element according to claim 1, wherein the flange comprises a first portion running radially with regard to a vertical axis of the pouring element and in a plane with the support wall and a second portion angled with regard to the vertical axis of the pouring element, and wherein only the lower side of the first portion is covered by the barrier film.

17. The reclosable pouring element according to claim 1, wherein the at least one cutting edge has only one circle of action of less than 360°.

* * * * *

UNITED STATES PATENT AND TRADEMARK OFFICE

CERTIFICATE OF CORRECTION

PATENT NO. : 9,238,531 B2
APPLICATION NO. : 13/878903
DATED : January 19, 2016
INVENTOR(S) : Sven Himmelsbach et al.

It is certified that error appears in the above-identified patent and that said Letters Patent is hereby corrected as shown below:

In the claims,

Column 6, Line 53, Claim 1, delete "bather" and insert -- barrier --

Column 6, Line 65, Claim 5, delete "claim" and insert -- claim 1, --

Signed and Sealed this
Third Day of May, 2016

Michelle K. Lee

Michelle K. Lee
*Director of the United States Patent and Trademark Office*